US005725159A

United States Patent [19]

Dorber et al.

[11] Patent Number: 5,725,159

[45] Date of Patent: Mar. 10, 1998

[54] AIR DIRECTING DEVICE FOR A HAIR DRYER

[75] Inventors: Ralf Dorber, Schmitten; Dieter Liebenthal, Maintal, both of Germany

[73] Assignee: Braun Aktiengesellschaft, Frankfurt, Germany

[21] Appl. No.: 588,824

[22] Filed: Jan. 19, 1996

[51] Int. Cl.[6] ..... B05B 1/14

[52] U.S. Cl. ..... 239/553.3; 239/590; 239/601; 34/97; D28/13

[58] Field of Search ..... 239/553.3, 589, 239/590, 601, 602, 524; 34/96–99; 392/383–385; D28/13, 15, 18

[56] References Cited

U.S. PATENT DOCUMENTS

| | | | |
|---|---|---|---|
| D. 239,471 | 4/1976 | Gonzales | D86/10 |
| D. 253,253 | 10/1979 | Rakocy | D28/13 |
| D. 265,597 | 7/1982 | Forsberg | D28/18 |
| D. 265,598 | 7/1982 | Radatz | D28/18 |
| D. 276,084 | 10/1984 | Long | D28/18 |
| D. 308,118 | 5/1990 | Brill | D28/18 |
| D. 341,224 | 11/1993 | Drake | D28/18 |
| D. 343,698 | 1/1994 | Sharples | D28/13 |
| 610,072 | 8/1898 | Mink | 34/96 |
| 2,633,908 | 4/1953 | Brierly | 239/553.3 |
| 4,019,260 | 4/1977 | Levy et al. | 34/97 |
| 4,287,673 | 9/1981 | Wolter | 34/97 |
| 4,528,919 | 7/1985 | Harbolt et al. | 239/553.3 |
| 4,615,347 | 10/1986 | Schooley | 132/9 |
| 4,794,225 | 12/1988 | Maese | 219/370 |
| 4,928,402 | 5/1990 | Allen | 239/97 |
| 5,129,582 | 7/1992 | Rieke et al. | 239/424.5 |
| 5,235,759 | 8/1993 | Rizzuto, Jr. | 34/97 |
| 5,275,339 | 1/1994 | Andis et al. | 239/443 |
| 5,392,528 | 2/1995 | McDougall | 34/97 |
| 5,457,894 | 10/1995 | Dorber | 34/98 |

FOREIGN PATENT DOCUMENTS

| | | | |
|---|---|---|---|
| 284-690-A | 10/1988 | European Pat. Off. | A45D 20/12 |
| 487932-A2 | 6/1992 | European Pat. Off. | A45D 20/12 |
| 41 00 509 A1 | 7/1992 | Germany | A45D 20/12 |
| 4321573 | 1/1995 | Germany . | |
| 2 270 838 | 3/1994 | United Kingdom | A45D 20/12 |
| WO 92/11783 | 7/1992 | WIPO | A45D 20/12 |
| WO 94/23611 | 10/1994 | WIPO | A45D 20/12 |

OTHER PUBLICATIONS

Hong Kong Enterprise Oct. 1993, p. 343: "New Air Diffuser" at center right (undated).

*Primary Examiner*—Andres Kashnikow
*Assistant Examiner*—Lisa Ann Douglas
*Attorney, Agent, or Firm*—Edward S. Podszus

[57] ABSTRACT

The invention is directed to an air directing device for a hair dryer for acting upon the air stream exiting from the hair dryer, in which an air directing member (10) is configured as a substantially tubular body (12) having an inlet opening (14) and an outlet area (16) for the air. The air outlet area (16) comprises a plurality of individual orifices (18) configured and positioned such that the exiting air stream is split into a plurality of substantially independent free jets.

45 Claims, 5 Drawing Sheets

AIR DIRECTING DEVICE FOR A HAIR DRYER

BACKGROUND OF THE INVENTION

This invention relates to an air directing device for a hair dryer for acting upon the air stream exiting from the hair dryer, in which an air directing member is configured as a substantially tubular body having an inlet opening and an outlet area for the air. Such air directing devices for hair dryers which are generally configured as nozzles or diffusers are widely known in the art. These air directing devices act upon the air stream discharged from the hair dryer such as to effect a concentration or, alternatively, a diffusion of the air stream. A feature all these air directing devices for hair dryers have in common is that the mean volumetric rate of airflow through the hair dryer is influenced not at all or only to a minor extent, being as a rule reduced.

SUMMARY OF THE INVENTION

It is therefore an object of the present invention to improve upon an air directing device of the type initially referred to in such a manner as to enable a significant increase in the volume of moved air to be accomplished at a specified distance forward of the air outlet area of the hair dryer. As a mean measure of such a distance, the distance customary selected by a user from the user's head for drying his or her hair is referred to, which distance is of the order of between 15 and 17 cm, approximately. According to the present invention, this object is substantially accomplished in that the air outlet area comprises a plurality of individual orifices configured and positioned such that the exiting air stream is split into a plurality of substantially independent free jets. By this means, the moved air volume increases significantly as the distance from the air outlet becomes greater, this being due to the entrainment of ambient air by the individual free jets. Owing to the splitting of the air stream into a plurality of free jets, the entrainment effect is enhanced to a high degree. Overall, the effective circumferential length of the individual jets is increased by comparison with the circumferential length of the normal air jet, enabling a considerable increase in the quantity of moved air to be accomplished as opposed to conventional hair dryers. Concomitant with the increase in the moved air volume is a lowering of the maximum air temperature by more than 10° C. at the distance referred to above so that, overall, a more gentle hair drying operation is made possible. Moreover, the presence of a plurality of air jets expedites the drying process because of turbulence imparted to the hair, in addition to producing a pleasant feeling on the scalp, similar to a massage.

Advantageously, the sum of the cross-sections of the individual orifices in the outlet area is substantially equal to the cross-section of the inlet opening, in particular, the ratio of the cross-sections assumes values in the range of between 0.65 and 1.1. By this means, the volumetric rate of airflow of the hair dryer is not reduced by more than 10%, which, in relation to a hair dryer having no air directing device, is by far balanced out by an up to 90% increase in the moved air volume at a distance of about 15 cm to 17 cm. In the following, when a percentage increase in the moved air volume is mentioned, the reference quantity is understood to be the quantity of moved air measured at this distance of the hair dryer without the air directing device of the present invention.

Advantageously, the diameter and the number of orifices are determined such that the mean air velocity, measured at the outlet area and related to the mean air velocity through the hair dryer without the air directing device, assumes values in the range of between 0.8 and 1.4.

In one embodiment, the body is of a funnel- or bell-shaped configuration and has at its upstream end a substantially circular inlet opening.

According to an advantageous further feature of the present invention, a plate having bores is provided at the downstream end of the body. In this arrangement, the bores are arranged on the plate in a circular and/or uniformly distributed pattern. By this means which preferably splits the air into six air jets, the moved air volume is increased by about 50% at a distance of about 17 cm, while the maximum air temperature is lowered by about 15° C. Advantageously, six bores with a diameter of 2 cm, approximately, are provided in the peripheral area of the plate.

Advantageously, the plate includes a further, substantially centrally disposed aperture, with the air jet exiting from the central aperture being suitable for use as a pointer jet, so to speak, for the proper orientation of the hair dryer relative to the hair to be treated.

According to another greatly advantageous feature of the present invention, one or several of the bores or apertures include tubular sections extending in downstream direction. The increase in the moved air volume which can be thereby accomplished is of the order of about 55% at a distance of about 17 cm, with the maximum air temperature being lowered by about 10° C.

Advantageously, at least one tubular section is outwardly inclined relative to a center line of the body, with the tubular section enclosing with the center line an angle of preferably between 0° and ±30°, in particular between ±10° and ±15°. In this arrangement, the inclination of the tubular sections relative to the center line is variable by means of an adjusting device. By this means, it is not only possible to control the shape of the air stream discharged from the air directing device, but it is also possible to vary the admixture of ambient air and thus the moved air volume and the lowering of the temperature of the moved air volume. To improve the flow behavior of the air directing device, the plate has on its impact side a substantially centrally disposed guiding body. The guiding body is substantially configured in the manner of a polygonal pyramid whose sides have a preferably inwardly extending curvature.

According to another advantageous embodiment of the present invention, circumferentially spaced alternating bosses and dimples are provided in the wall of the body, such that the diameter at the downstream end of the wall varies periodically between an inside diameter and an outside diameter, with a substantially centrally disposed plate being provided in the outlet area. By this means, too, a plurality of free jets exiting from the attachment device are produced, providing the beneficial effects initially described.

Advantageously, the diameter of the plate corresponds substantially to the inside diameter.

By providing the plate with a preferably centrally disposed bore, this embodiment makes equally sure that a "pointer jet" is generated, facilitating handling, in particular the orientation of the hair dryer relative to the user's head for drying his or her hair.

In a further feature of the present invention, the plate includes a plurality of apertures arranged on an outer annular area and a central inner area, which apertures are adapted to be opened and, alternatively, closed by means of a controllable screen. By this means it is possible to control the number of free jets discharged from the air directing device and/or the shape of the moved air volume.

In an advantageous embodiment, the plate has on its downstream side in the inner area a conventional nozzle arranged in particular rotatably. This provides the possibility to operate the hair dryer with a nozzle in the conventional manner, in addition to ensuring an increase in the moved air volume which is accomplished by suitably maneuvering the screen. In this arrangement, the screen is rotatably mounted on the plate and provided with an actuating lever.

In another embodiment of the present invention, the air directing device is made integrally with the housing of the hair dryer. It will be understood that the possibility also exists to configure the air directing device as an attachment, securing it releasably to the air outlet of the hair dryer by locking means or clamping means or the like.

Overall, practical examinations have shown that the present invention enables a greater volume of moved air to be present at an ergonomically favorable distance between the hair dryer and the head, that turbulence is reliably imparted to the hair by individual free jets, and that the surface area exposed to airflow is increased by 130% up to 240%, with the increase incurring an only minor reduction of the maximum air velocities. Further, the maximum air temperature is lowered by about 10° C. and more, thus enabling a particularly gentle hair drying action to be performed. The drying action is expedited by the increase in the moved air volume, the individual free jets producing a pleasant feeling on the user's scalp.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims and their back-references.

DETAILED DESCRIPTION OF THE DRAWINGS

Figure 1:
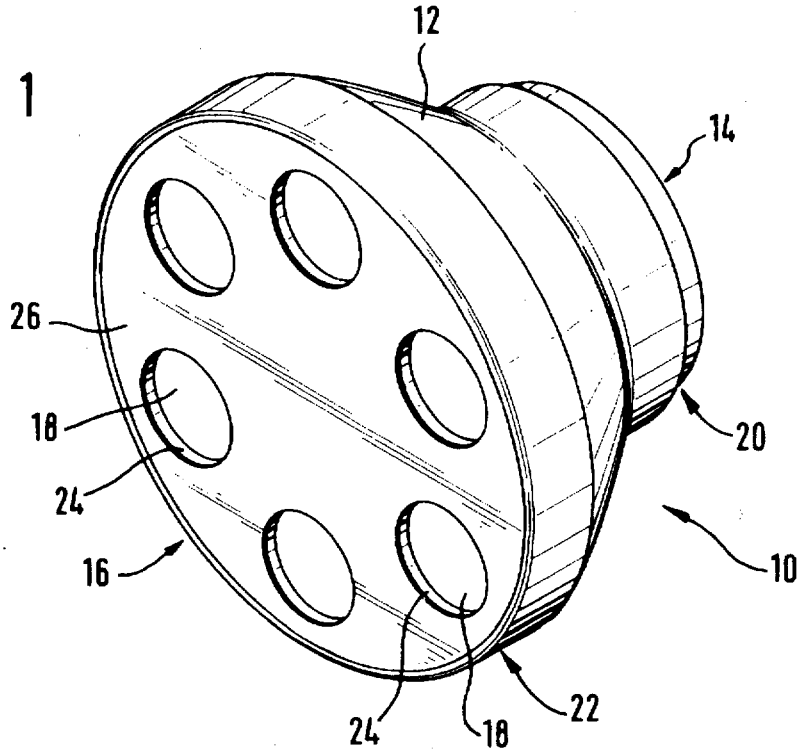
FIGS. 1, 2 and 3 are, respectively, a perspective view, a rear view and a sectional view taken along the line III—III of FIG. 2, of a first embodiment of the present invention.
Figure 2:
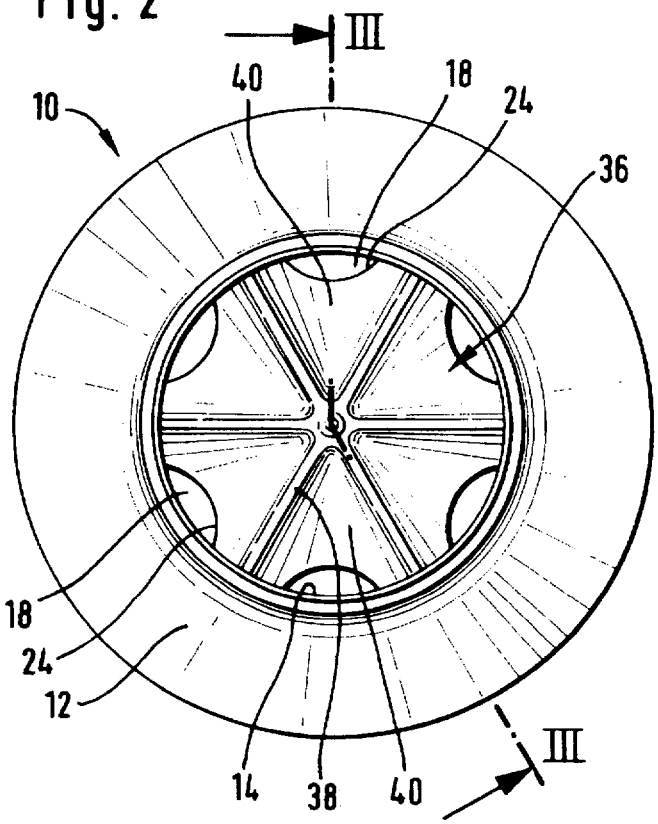
Figure 3:
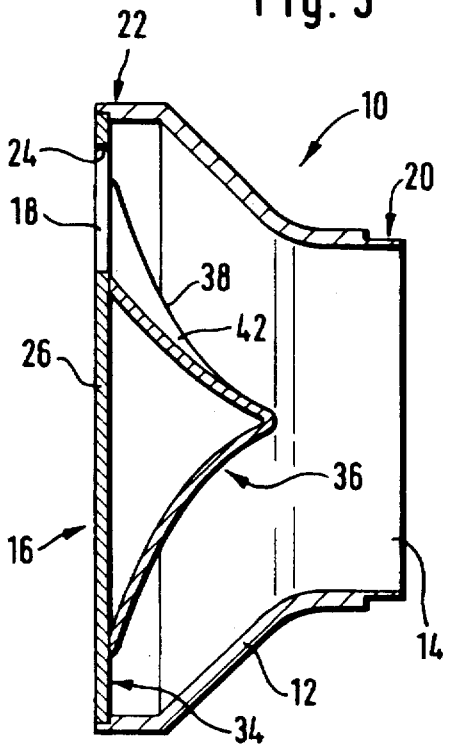
Figure 4:
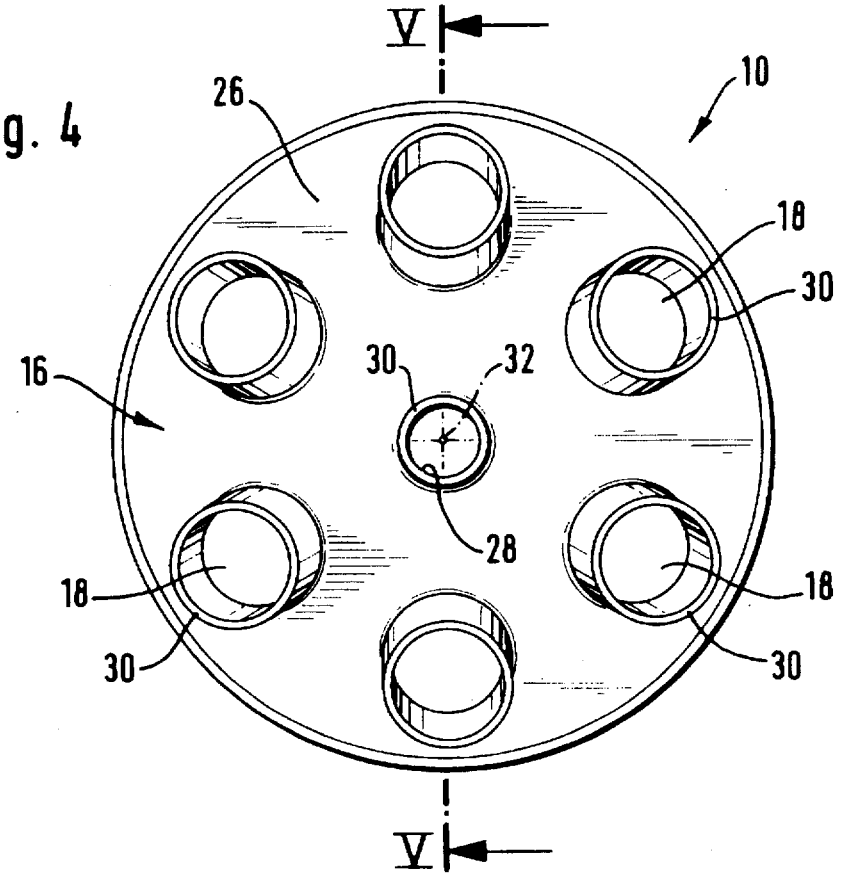
FIGS. 4 and 5 are, respectively, a front view and a sectional view taken along the line V—V of FIG. 4, of another embodiment of the present invention.
Figure 5:
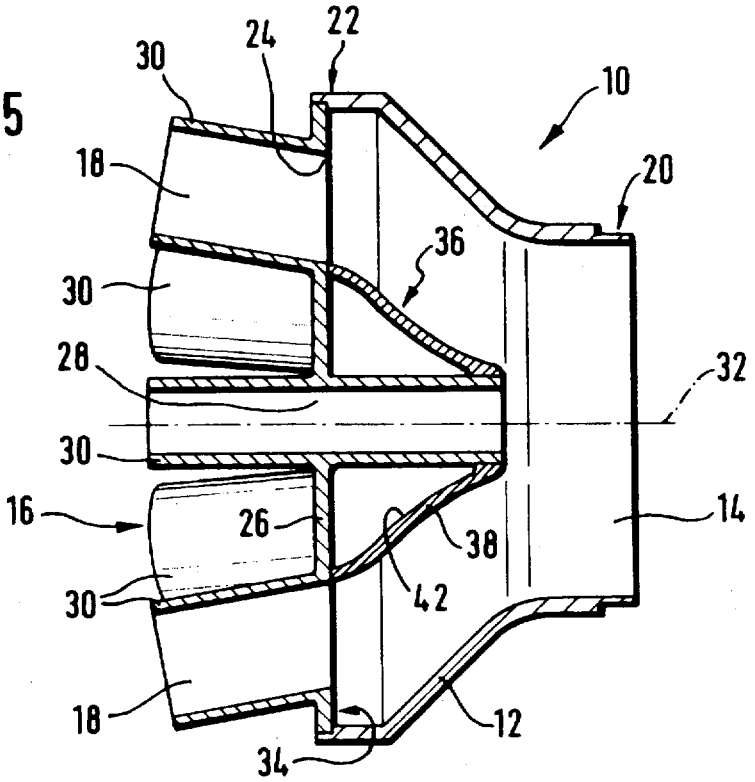
Figure 7:
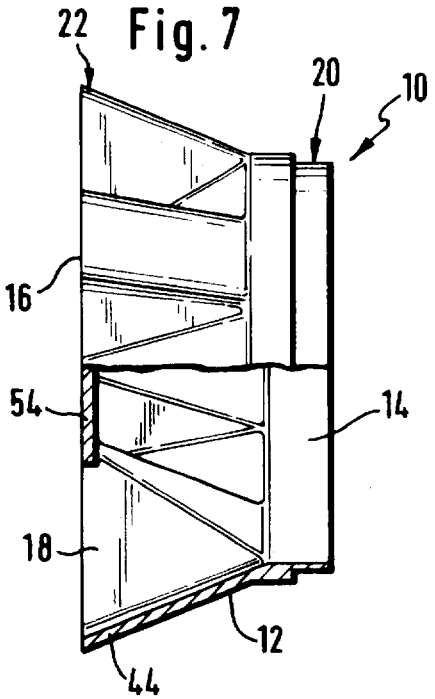
FIGS. 6 and 7 are, respectively, a front view and a sectional view taken along the line VII—VII of FIG. 6, of still another embodiment of the present invention.
Figure 6:
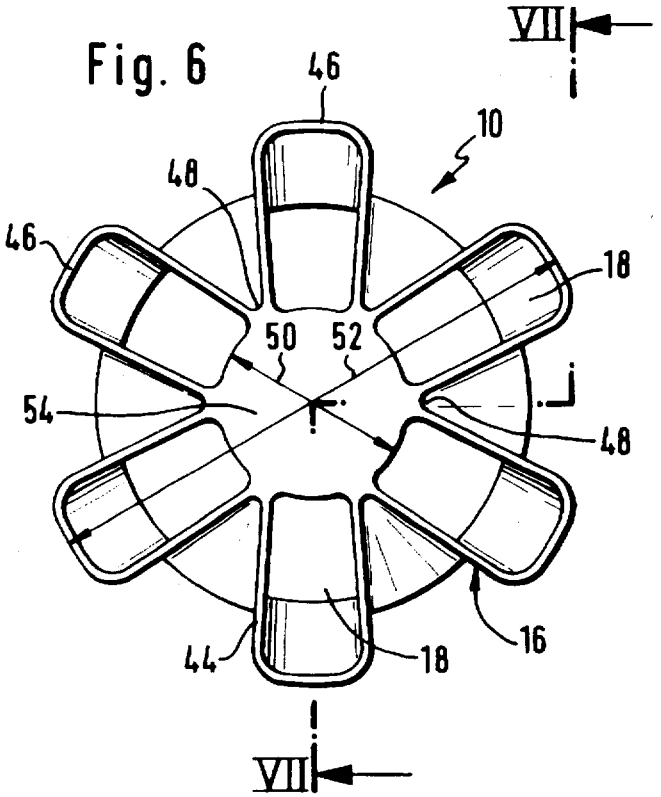
Figure 9:
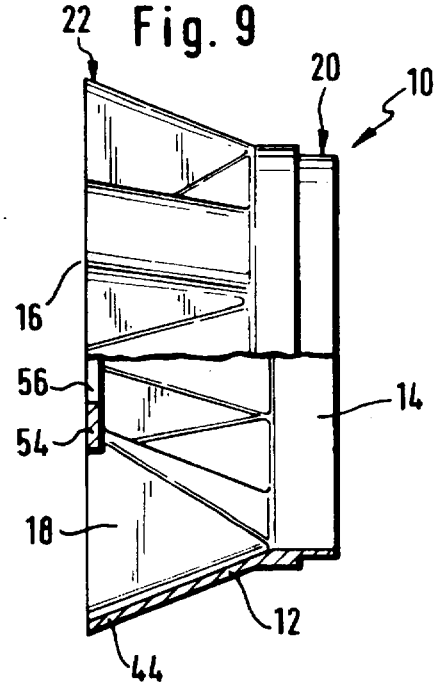
FIGS. 8 and 9 are, respectively, a front view and a sectional view taken along the line IX—IX of FIG. 8, of a further embodiment of the present invention.
Figure 8:
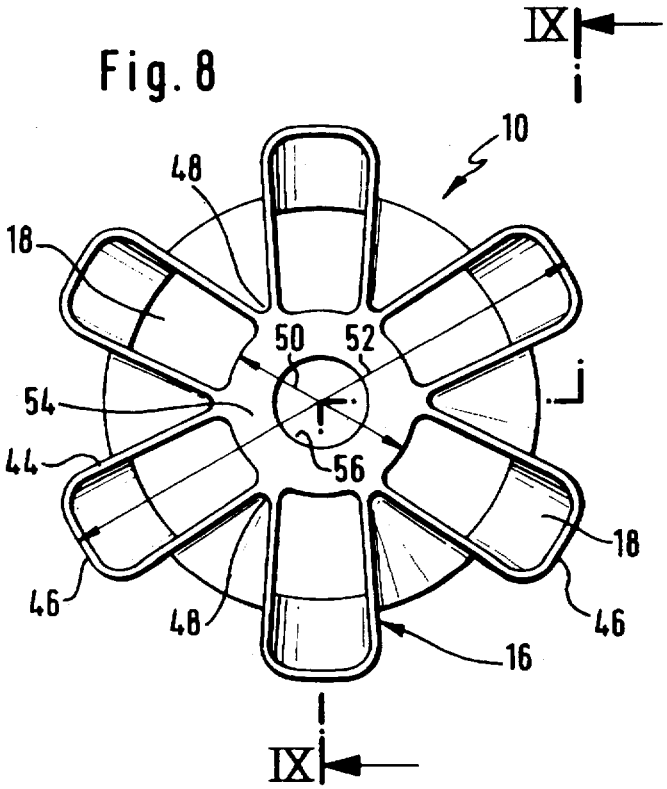
Figure 10:
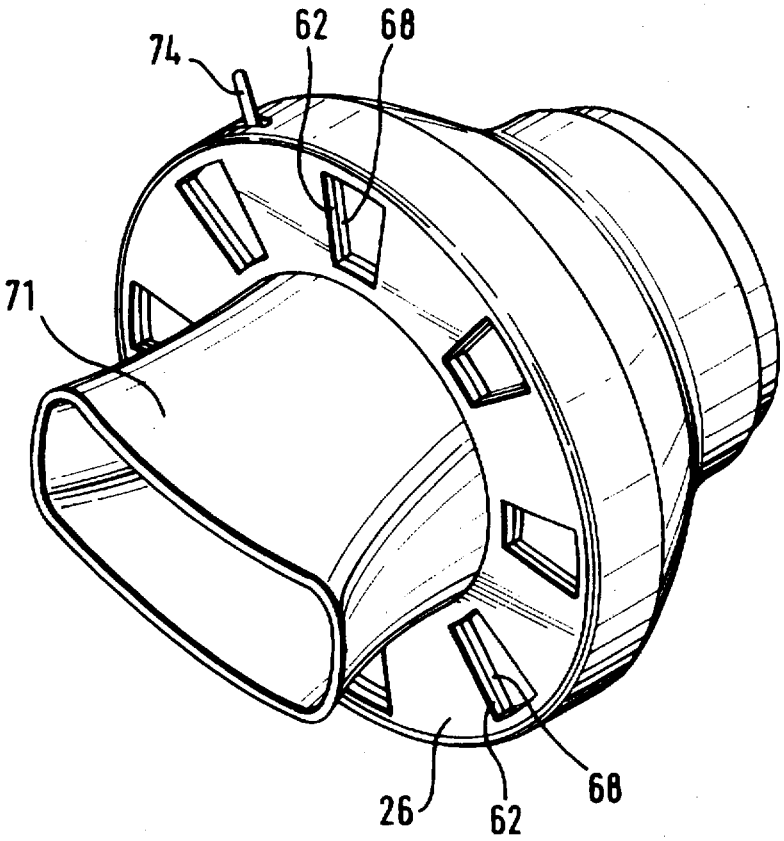
FIGS. 10, 11 and 12 are, respectively, a perspective view and front views of yet another embodiment of the present invention.
Figure 11:
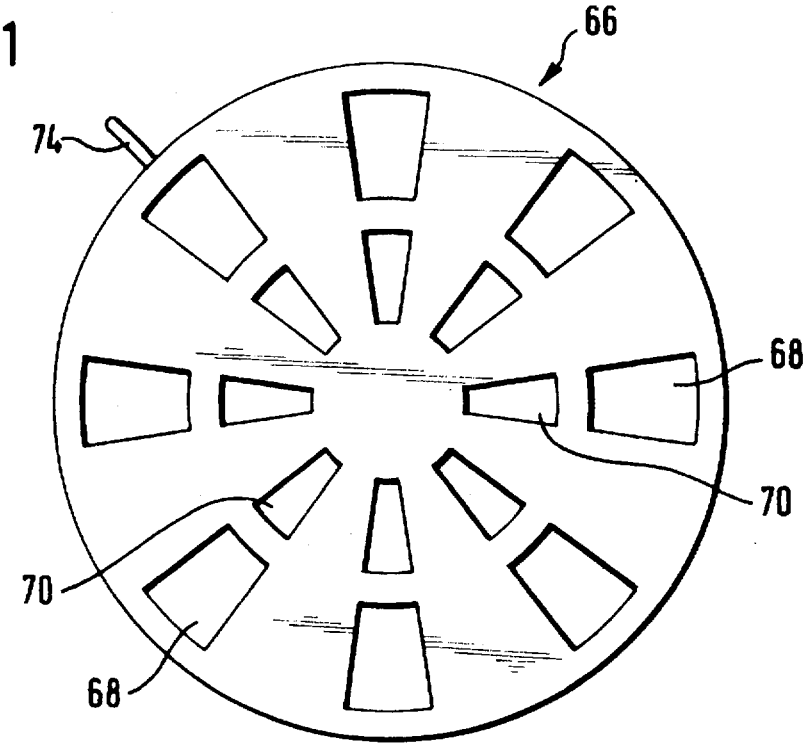
Figure 12:
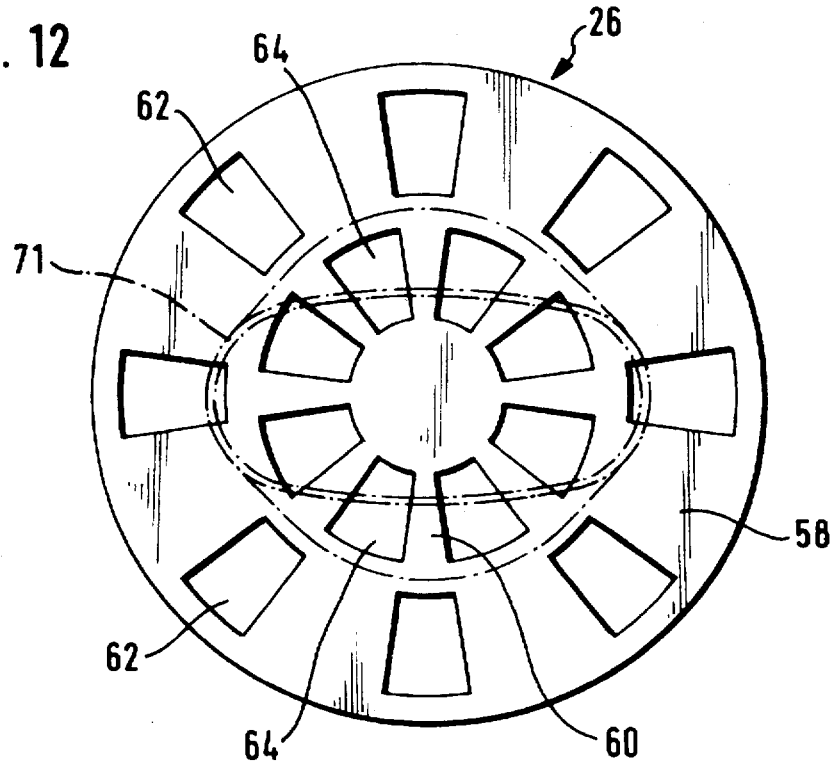

An air directing member 10 adapted to be attached to the air outlet opening of a hair dryer or formed integrally with the hair dryer housing, is generally comprised of a substantially tubular body 12 having an inlet opening 14 and an outlet area 16. Depending on the application, the tubular body 12 is, for instance, of a cup-shaped, a funnel-shaped, a bell-shaped configuration or the like. The inlet opening provided at an upstream end 20 is cylindrical, while a downstream end 22 of the tubular body 12 includes a plate 26 in which several bores 24 are provided. The bores 24 are disposed in an outer circular ring section of the plate 26 and are spaced uniformly apart in a circular array. In this array, the sum of the cross-sections of the individual orifices 18, i.e., bores 24, assumes values corresponding substantially to the cross-section of the inlet opening 14, their ratio to the inlet cross-section being 0.65 to 1.1, approximately. The diameter and the number of orifices 18 and apertures 28 are fixed in particular such that the mean air velocity, measured in the outlet area 16 and related to the mean air velocity through the hair dryer without air directing member 10, assumes values in the range of between 0.8 and 1.4, approximately. The configuration and relative arrangement of the bores 24, i.e., orifices 18, is such that the exiting air stream is split into a plurality of substantially independent free jets.

Provided on the impact side 34 of the plate 26 is a substantially centrally arranged guiding body 36. Depending on the array of the bores 24 in the plate 26, the guiding body 36 is configured individually, in particular in the manner of a polygonal pyramid 38 whose sides 40 have a preferably inwardly extending curvature 42.

In a further embodiment, the plate 26 includes a substantially centrally disposed aperture 28. Tubular sections 30 extending in downstream direction are provided in the aperture 28 as well as in the bores 24. The tubular sections 30 are outwardly inclined relative to a center line 32 of the tubular body 12, enclosing with the center line 32 an angle of between ±5° and ±30°, in particular between ±10° and ±15°. Advantageously, the inclination of the tubular sections 30 relative to the center line 32 is variable by means of an adjusting device. One way of implementing this adjusting device involves providing the upstream ends of the tubular sections 30 with a spherical thickening received in a spherical socket of the plate 26. Using, for example, a control cam cooperating with the tubular sections 30, it is possible to adjust the inclination of the tubular sections 30 relative to the center line 32. However, it will be appreciated that also other constructions of adjusting devices are possible, their implementation being within the scope of considerations of a person having ordinary skill in the art.

According to a further embodiment, the wall 44 of the tubular body 12 is provided with circumferentially spaced alternating bosses 46 and dimples 48 whose height and depth, respectively, become progressively greater from the upstream end 20 to the downstream end 22, particularly in a linear fashion. Arrangement and configuration of these bosses 46 and dimples 48 are such that the diameter at the downstream end 22 of the wall 44 varies periodically between an inside diameter 50 and an outside diameter 52. Provided in the outlet area 16 is a substantially centrally disposed plate 54 of a diameter corresponding substantially to the inside diameter 50. By this means, too, it is ensured that the air outlet area 16 includes a plurality of separate orifices 18 from which free jets may be discharged substantially independently.

According to another embodiment, the plate 24 has a preferably centrally disposed bore 56, being configured as a disk, so to speak. This bore 56 as well as the aperture 28 which are preferably of a smaller cross-section than the orifices 18, make sure that a concentrated jet is discharged through the center of the outlet area 16 of the tubular body 12. This air jet has the function of indicating to the user the proper positioning of the outlet area 16 relative to the sections of hair to be dried.

In still another embodiment, the plate 26 includes a plurality of apertures 62, 64 disposed on an outer annular area 58 and a central inner area 60, which apertures are adapted to be opened and, alternatively, closed by means of a controllable screen 66. On the downstream side 72, a conventional nozzle 71 is arranged on the plate 26, the nozzle having its inlet opening in overlap with both the central inner area 60 and the apertures 64. The screen 66 has apertures 68 in its outer annular area, and apertures 70 in its central inner area. The screen 66 is rotatably disposed upstream behind the plate 26, rotation relative to the plate 26 being effected by means of an actuating lever 74. With the screen 66 in the position relative to the plate 26 as shown in the Figures, the apertures 62 and 68 will be in registration, causing air to be discharged in the form of individual free jets through the outer annular area 58 of the plate 26. By rotating the screen 66 relative to the plate 26 by a small angle to the left or right, the apertures 62 in the plate 26 will be closed, whilst the apertures 64 which are then at least in partial registration with the apertures 70, will be opened. In this position, air will be discharged exclusively through the central inner area 60 of the plate 26, the nozzle 71 located in this area then directing a focused and concentrated flow at the user's hair for drying.

It will be understood that the air directing device may be made integrally with the housing of the hair dryer or, alternatively, it may be configured as a separate attachment securable to the hair dryer housing. In the latter case, the air directing device is releasably securable to the air outlet of the hair dryer by suitable locking means or clamping means or the like.

We claim:

1. An air directing device for an air-moving appliance, comprising a body member having an air inlet region and an air outlet region and defining an air plenum communicating air therebetween, wherein the air outlet region comprises a plurality of air exit regions directing exiting air into a plurality of non-convergent air exit streams at the air outlet region, the air outlet region further comprising a centrally disposed air impingement structure, said central air impingement structure at least partially bounding the air exit regions, whereby a mean exit air velocity of air discharged from the air exit regions measured adjacent the air outlet region is in a ratio from about 0.8:1 to about 1.4:1 compared to a mean air velocity emanating from the air moving appliance without the air directing device.

2. An air directing device as claimed in claim 1, wherein the air exit regions comprise separate apertures formed in the air outlet region.

3. An air directing device for an air-moving appliance, comprising a body member having an air inlet region and an air outlet region and defining an air plenum communicating air therebetween, wherein the air outlet region comprises at least a first air exit region and a second air exit region discharging a plurality of air streams at the air outlet region that are non-convergent, the air outlet region further comprising a centrally disposed air impingement structure at least partially bounding said at least first and second air exit regions, whereby the plurality of exiting air streams entrains ambient air and increases by at least about 50% a moved air volume at a distance of from about 15 cm to about 17 cm from the air outlet region compared to a moved air volume at the said distance of the air-moving appliance without the air-directing device.

4. An air directing device as claimed in claim 3, wherein the plurality of exiting air streams entrains ambient air and increases by from about 50% up to about 90% the moved air volume at the said distance.

5. An air directing device as claimed in claim 3, wherein the air exit regions comprise separate apertures formed in the air outlet region.

6. An air directing device as claimed in claim 3, whereby a cross sectional area of said air exit regions is in a ratio of from about 0.65:1 to about 1.1:1 compared to a cross sectional area of the air inlet region.

7. An air directing device as claimed in claim 6, whereby a mean exit air velocity of air discharged from the air exit regions measured adjacent the air outlet region is in a ratio of from about 0.8:1 to about 1.4:1 compared to a mean air velocity emanating from the air moving appliance without the air-directing device.

8. An air directing device for an air-moving appliance, comprising a body member having an air inlet region and an air outlet region and defining an air plenum communicating air therebetween, wherein the air outlet region comprises at least a first air exit region and a second air exit region, each said air exit region further comprising opposed wall segments channeling air flow therebetween for discharging air along a principal air discharge axis, wherein the opposed wall segments intersect, and wherein a cross sectional area of said air exit regions within the opposed wall segments is in a ratio of from about 0.65:1 to about 1.1:1 compared to a cross sectional area of the air inlet region.

9. An air directing device as claimed in claim 8, wherein the first air exit region is spatially separated from the second air exit region.

10. An air directing device as claimed in claim 8, wherein the first principal air discharge axis of the first air exit region is directed non-convergent with the second principal air discharge axis of the second air exit region.

11. An air directing device as claimed in claim 8, wherein the opposed wall segments form a circular aperture defining the respective air exit region.

12. An air directing device as claimed in claim 8, whereby a mean exit air velocity of air discharged from the air exit regions measured adjacent the air outlet region is in a ratio of from about 0.8:1 to about 1.4:1 compared to a mean air velocity emanating from the air-moving appliance without the air directing device.

13. An air directing device as claimed in claim 8 in combination with the air-moving appliance.

14. An air directing device for an air-moving appliance, comprising a body member having an air inlet region and an air outlet region and defining an air plenum communicating air therebetween, wherein the air outlet region comprises at least a first air exit region and a second air exit region, each said air exit region further comprising opposed wall segments channeling air flow therebetween for discharging air along a principal air discharge axis, wherein the opposed wall segments form a closed periphery bounding the respective air exit region, and wherein a cross sectional area of said air exit regions within the opposed wall segments is in a ratio of from about 0.65:1 to about 1.1:1 compared to a cross-sectional area of the air inlet region.

15. An air directing device for an air-moving appliance, comprising a body member having an air inlet opening for receiving an air stream from the air-moving appliance and an air outlet region and defining an air plenum communicating air therebetween, wherein the air outlet region comprises a plurality of air exit orifices directing a plurality of non-convergent air exit streams from the air outlet region, the air outlet region further comprising a centrally disposed air impingement structure, said central air impingement structure at least partially bounding opposed air exits orifices, and wherein a cross sectional area of said plurality of air exit orifices is in a ratio of from about 0.65:1 to about 1.1:1 compared to a cross sectional area of the air inlet opening.

16. An air directing device as claimed in claim 15, wherein the cross sectional area of said plurality of air exit orifices is in a ratio of about 1:1 compared to a cross sectional area of the air inlet opening.

17. An air directing device as claimed in claim 15, wherein a mean exit air velocity of the air exit streams measured adjacent the air outlet region is in a ratio of from about 0.8:1 to about 1.4:1 compared to a mean velocity of the air stream emanating from the air-moving appliance without the air directing device.

18. An air directing device as claimed in claim 15, wherein the body member is selected from a group of objects consisting of a cup-shaped body, a funnel-shaped body and a bell-shaped body.

19. An air directing device as claimed in claim 18, wherein the air inlet opening is circular.

20. An air directing device as claimed in claim 15, wherein the air outlet region further comprises an air impingement plate in which the air exit orifices are disposed.

21. An air directing device as claimed in claim 20, wherein the air exit orifices are uniformly distributed on the surface of the air impingement plate.

22. An air directing device as claimed in a claim 20, wherein the air impingement plate further comprises a centrally disposed air exit aperture.

23. An air directing device as claimed in claim 20, wherein the air impingement plate further comprises on its air inlet surface the centrally disposed air impingement structure.

24. An air directing device as claimed in claim 23, wherein the air impingement structure further comprises a polygonal pyramid having sides extending towards the air exit orifices.

25. An air directing device as claimed in claim 15, wherein at least one air exit orifice further comprises a conduit segment disposed on an air exit surface of the air outlet region and extending away therefrom.

26. An air directing device as claimed in claim 25, wherein the conduit segment has a longitudinal axis inclined away from a center line of the body member at an angle of between ±5° to ±30°.

27. An air directing device as claimed in claim 26, wherein the angle of inclination is between ±10° and ±15°.

28. An air directing device as claimed in claim 25, characterized in that the inclination of a longitudinal axis of the conduit segment is variably positionable by means of an adjusting device.

29. An air directing device as claimed in claim 15, wherein the plurality of air exit orifices is disposed in an outer annular area of the air outlet region and the air outlet region further comprises a second plurality of air exit orifices disposed in an inner annular area of the air outlet region, and further comprising an apertured diaphragm element adjacent the air outlet region and disposed for selectablely positionable movement relative thereto to alternately open one of the first and second pluralities of orifices and close the other.

30. An air directing device as claimed in claim 29, further comprising an air concentrator nozzle disposed on an air exit surface of the air outlet region in registry with the second plurality of air exit orifices.

31. An air directing device as claimed in claim 30, wherein the nozzle is disposed for rotational movement relative to the air outlet region.

32. An air directing device as claimed in claim 29, wherein the diaphragm is rotatably mounted on the air outlet region and provided with an actuating means.

33. An air directing device for an air-moving appliance, comprising a body member having an air inlet opening for receiving an air stream from the air-moving appliance and an air outlet region and defining an air plenum communicating air therebetween, wherein the air outlet region further comprises a plurality of peripherally spaced alternating bosses and dimples formed in a wall of the body member adjacent the air outlet region such that a distance measured from a center line of the body member to the boss or the dimple along the periphery varies periodically between an inner diameter and an outer diameter, wherein a cross sectional area bounded by said bosses and dimples is in a ratio of from about 0.65:1 to about 1.1:1 compared to a cross sectional area of the air inlet opening.

34. An air directing device as claimed in claim 33, wherein the air outlet further comprises a centrally disposed air impingement structure located between the dimples.

35. An air directing device as claimed in claim 34, wherein the diameter of the plate corresponds to the inside diameter.

36. An air directing device as claimed in claim 34, wherein the plate further comprises a second plurality of air exit orifices disposed in an inner annular area of the air outlet region, and further comprising an apertured diaphragm element adjacent the air outlet region and disposed for selectablely positionable movement relative thereto to alternately open one of the second plurality of orifices and the air outlet region within the bosses and dimples and close the other.

37. An air directing device as claimed in claim 36, further comprising an air concentrator nozzle disposed on the plate in registry with the second plurality of air exit orifices.

38. An air directing device as claimed in claim 37, wherein the nozzle is disposed for selectable rotational motion relative to the plate.

39. An air directing device as claimed in claim 34, wherein the air impingement structure is a plate.

40. An air directing device as claimed in claim 34, wherein the air impingement structure divides the air outlet region into a plurality of separate apertures each bounded between adjacent dimples by respective portions of a said boss and of said air impingement structure.

41. An air directing device as claimed in claim 33, wherein the plate further comprises a centrally disposed bore.

42. An air directing device as claimed in claim 33, whereby a mean exit air velocity of air discharged from the air outlet region within the bosses and dimples measured adjacent the said air outlet region is in a ratio of from about 0.8:1 to about 1.4:1 compared to a mean air velocity emanating from the air moving appliance without the air-directing device.

43. An air directing device as claimed in claim 42, whereby the ratio is about 1:1.

44. An air directing device as claimed in claim 33 in combination with the air-moving appliance.

45. An air directing device as claimed in claim 15 in combination with the air-moving appliance.

* * * * *